US005829629A

United States Patent [19]

Usher

[11] Patent Number: 5,829,629

[45] Date of Patent: Nov. 3, 1998

[54] COMPRESSED GAS CYLINDER CONTAINER

[76] Inventor: Timothy J. Usher, P.O. Box 1126, Bolton Landing, N.Y. 12814

[21] Appl. No.: 871,278

[22] Filed: Jun. 9, 1997

[51] Int. Cl.[6] ..... B65D 25/20

[52] U.S. Cl. ..... 220/724; 220/740; 220/23.91; 220/89.1; 220/921; 220/759

[58] Field of Search ..... 220/737, 740, 220/724, 447, 448, 446, 445, 581, 586, 400, 759, 758, 756, 760, 89.1, 23.91, 918, 921

[56] References Cited

U.S. PATENT DOCUMENTS

| | | | |
|---|---|---|---|
| 2,103,677 | 12/1937 | Kline et al. | 220/448 |
| 2,320,170 | 5/1943 | Bishop et al. | 220/447 |
| 2,465,095 | 3/1949 | Harvey | 220/46 |
| 2,738,114 | 3/1956 | Kahlan et al. | 220/758 |
| 2,756,105 | 7/1956 | Magill | 299/95 |
| 2,915,640 | 12/1959 | Grubel et al. | 250/108 |
| 3,043,466 | 7/1962 | Gardner | 220/448 |
| 3,192,978 | 7/1965 | Horvath | 150/5 |
| 3,788,511 | 1/1974 | Marsh | 220/445 |
| 3,819,081 | 6/1974 | Runte | 220/17 |
| 3,921,872 | 11/1975 | Buell, Jr. | 224/45 R |
| 4,022,343 | 5/1977 | Richardson | 220/3 |
| 4,964,529 | 10/1990 | Houston | 220/445 |
| 4,967,923 | 11/1990 | Wren | 220/3 |
| 5,002,193 | 3/1991 | Touzani | 215/100 A |
| 5,190,151 | 3/1993 | Dietterich | 206/214 |
| 5,217,131 | 6/1993 | Andrews | 220/1.5 |
| 5,261,554 | 11/1993 | Forbes | 220/740 |
| 5,407,093 | 4/1995 | McGill | 220/666 |
| 5,515,971 | 5/1996 | Segrest | 206/418 |

FOREIGN PATENT DOCUMENTS

| | | | |
|---|---|---|---|
| 542 284 | 8/1922 | France | 220/447 |

*Primary Examiner*—Stephen J. Castellano
*Attorney, Agent, or Firm*—Heslin & Rothenberg, P.C.

[57] ABSTRACT

A compressed gas cylinder container useable to protect the gas cylinder from impact and from exterior contaminants is disclosed. The container includes a lower spacer for positioning within an inner portion of the container and shaped to form a space between a lower end of a compressed gas cylinder and an inner portion of a bottom end of the container. An upper spacer having an opening therein is sized for insertion around a top portion of a compressed gas cylinder to form a space between the side of the top of the compressed gas cylinder and the inner side walls of the top portion of the container. The inner side wall of the container separated from the compressed gas cylinder by a space therebetween to protect the compressed gas cylinder from impact to the container.

12 Claims, 1 Drawing Sheet

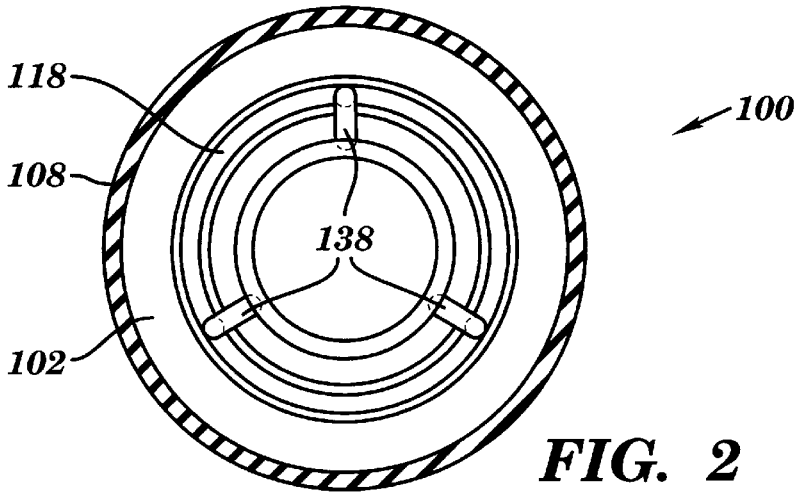
FIG. 2
FIG. 1
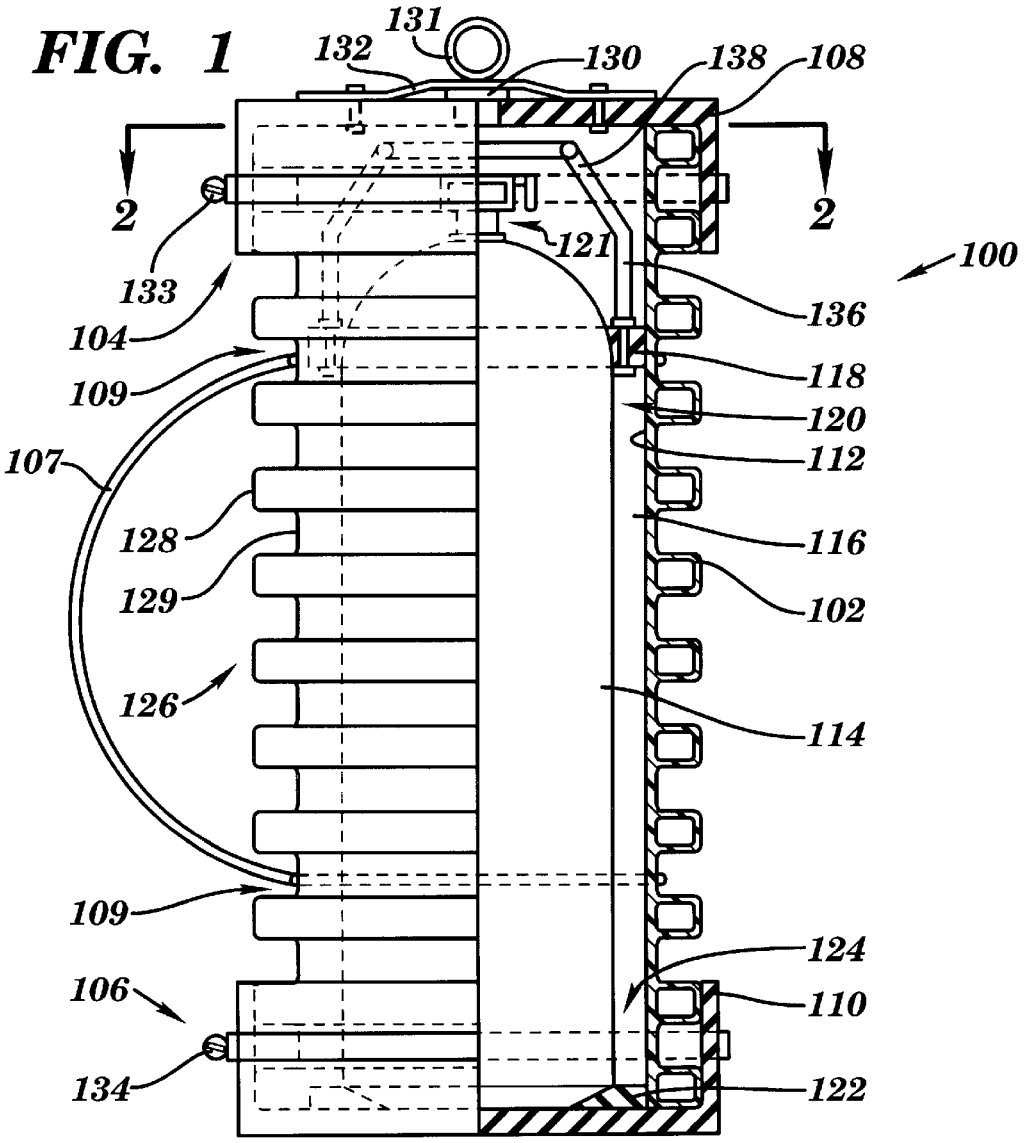

COMPRESSED GAS CYLINDER CONTAINER

TECHNICAL FIELD

This invention relates, in general, to containers for holding compressed gas cylinders and, in particular, to a compressed gas cylinder container capable of protecting a compressed gas cylinder from impact.

BACKGROUND ART

Compressed gas cylinders are used in various applications. Typically, a compressed gas cylinder comprises a steel cylindrical body having a valve means at the top thereof which may include a pressure gauge. The compressed gas within the cylinder is maintained within the cylinder at high pressures. Therefore, it is often necessary to avoid impact, puncture, or other damage to the cylinder which could create extreme danger or even an explosion. There presently exist, containers for compressed gas cylinders. However, such containers suffer from a variety of shortcomings and may not adequately protect the compressed gas cylinders therein from impact.

In one type of gas cylinder container, four radially directed through-slots are spaced circumferentially around the midsection of a body that can receive a gas cylinder. The user threads a strap through the slots and operates a toggle on the strap to alternatively tighten or release the strap around a gas cylinder inserted into the body. Handles are located on the midsection and end of the body for improved handling. Footings are located on the body exterior in order to prevent rolling of the body about its longitudinal axis. Such a design is disclosed in U.S. Pat. No. 3,921,872 to Buell, Jr. This type of container, however, does not prevent longitudinal movement or shifting of the gas cylinder. The body does not adequately protect the inserted gas cylinder against radial exterior impact or denting. Also, the slots do not adequately seal the gas cylinder against exterior-contaminant exposure.

In another type of container, upper and lower cap-skirts receive the ends of a gas cylinder. A user threads a strap through apertures and grooves on the cap-skirts and runs the strap along sides of a gas cylinder received between the cap-skirts. The user alternatively tightens and releases the strap around the received gas cylinder by operating spring clasps on the strap. A number of radial projections appear on one or more of the cap-skirts in order to prevent rotation of the received gas cylinder about its longitudinal axis. Such a design is disclosed in U.S. Pat. No. 4,022,343 to Richardson. However, the cap-skirts may not adequately seal the gas cylinder against exterior-contaminant exposure. Moreover, the cap-skirts do not protect the received gas cylinder against radial exterior impact or denting.

A known configuration of a safety device for a fluid container provides a cap for covering a valved-end of the fluid container. A flexible membrane having a central opening and a downwardly-extending inverted-yoke are secured at the bottom rim of the cap. The flexible membrane is for sealing within the cap the valved-end of the container after insertion through its central opening. The downwardly-extending inverted-yoke is for retaining the opposite end of the container. In one embodiment, forcing the valved-end of the container through the central opening of a flexible membrane fixed at the cap bottom-rim and catching the opposite end of the container with the inverted-yoke cooperate to seal the valved-end of the container within the cap and above the flexible membrane. In another embodiment, the valved-end of the container is inserted through the central opening of the flexible membrane and into the cap and the opposite end is set into the inverted-yoke and then the valved-end of the container is sealed above the flexible membrane by axially drawing and clamping taut the flexible membrane. Such a design is disclosed in U.S. Pat. No. 2,465,095 to Harvey. However, the cap and inverted-yoke do not fully seal the container below the flexible membrane against exterior contaminant exposure and protect the container below the flexible membrane against radial exterior impact or denting.

Thus, a need exists for an impact resistant compressed gas cylinder container that protects the gas cylinder against exterior impact or denting. An additional need exists for a technique that allows sealing of the container against exterior-contaminant exposure. A further need exists to provide such protection and to secure the container against longitudinal movement or shifting. Another need exists for a technique that allows the cylinder to be sealed against exposure while being longitudinally secured.

SUMMARY OF THE INVENTION

The shortcomings of the prior art are overcome and additional advantages provided with the compressed gas cylinder constructed in accordance with the present invention.

The compressed gas cylinder container includes a lower spacer for positioning within an inner portion of the container and shaped to form a space between a lower end of a compressed gas cylinder and an inner portion of a bottom end of the container. An upper spacer having an opening therein is sized for insertion around a top portion of a compressed gas cylinder to form a space between the side of the top of the compressed gas cylinder and the inner side walls of the top portion of the container. The inner side wall of the container separated from the compressed gas cylinder by a space therebetween to protect the compressed gas cylinder from impact to the container.

In yet another aspect of the invention, the compressed gas cylinder comprises an elongate container sized and adapted to receive a compressed gas cylinder axial therein wherein the space exists between the gas cylinder and the inside surface of the container. A first spacer is adapted for mounting on a first end of the compressed gas cylinder so that it contacts the inner wall of the container and the compressed gas cylinder to create a space therebetween. A second spacer is located within a second end of the container and sized to receive a second end of the gas cylinder to maintain the second end of the container in alignment with the second end of the container and to maintain a space between the second end of the compressed gas cylinder and the inner wall of the container. The compressed gas cylinder is prevented from axial and radial movement relative to the container by the first and second spacer.

The container may also include a means for mounting a first spacer on the first end of the compressed gas cylinder. The first spacer may be a ring mountable around the first end of the compressed gas cylinder, and may be made of a resilient material such as rubber. The means for mounting the first spacer may include a handle protruding from the ring which may be exposed within an opening in the first end of the container for insertion and removal thereof. The first end of the container may include a cap mountable over the opening to close the same. The cap may be secured over the opening using a clamp. The second end of the container may also comprise a second opening and a second cap may be mountable over the second opening to close the same. Again, the second cap may be secured over the second opening using a clamp. The container may be adapted to allow a maximum pressure therein and may also include a pressure relief valve therein. Furthermore, the first and/or second cap may be adapted or affixed onto a tube portion of the container to allow pressure within the container to be relieved when the pressure reaches a maximum value. The tube portion of the container may be corrugated, particularly on its exterior. The container may also include a means for carrying the container, which may include a strap mounted to the exterior thereof.

The invention also includes a method for protecting a compressed gas cylinder. The method includes aligning a compressed gas cylinder within an elongate container, mounting the first spacer on a first end of the compressed gas cylinder such that the first spacer contacts the inner side wall of the first end of the container and the first end of the cylinder to create a space therebetween, placing a second end of the compressed gas cylinder within a second spacer located at a second end of the container to maintain a space between the second end of the compressed gas cylinder and an inner side wall of the second end of the container, and maintaining the compressed gas cylinder in axial and radial alignment with the container.

Additional features and advantages are realized through the structures and techniques of the present invention. Other embodiments and aspects of the invention are described in detail herein.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be apparent from the following detailed description of preferred embodiments taken in conjunction with the accompanying drawings in which:

FIG. 1 is a partial cutaway view of one example of a container incorporating and using the protection and positioning capabilities of the present invention; and FIG. 2 is a partial cutaway, sectional view of the container taken substantially along line 2—2 of FIG. 1.

DETAILED DESCRIPTION

In accordance with the principles of the present invention, an impact resistant compressed gas cylinder container is provided in which the gas cylinder is protected against transverse, i.e., radial, exterior impact or denting. Additionally, the container is sealed against exterior-contaminant exposure. Furthermore, the container secures the compressed gas cylinder against longitudinal movement or shifting, as described herein.

One example of a container incorporating and using the protection and positioning capabilities of the present invention is depicted in FIG. 1 and described in detail herein.

In one embodiment, container 100 includes tube 102 having first end 104 and second end 106. The first end of the tube can be covered by first cap 108. The second end of the tube can be covered by second cap 110. The tube has inner walls 112 that can receive compressed gas cylinder 114 therethrough with spare surrounding space 116. First spacer 118 aligns first end 120 of the compressed gas cylinder in the spare surrounding space in the first end of the tube. Generally, the first end of the compressed gas cylinder includes valve 121 through which the compressed gas cylinder was previously filled and from which the end-user will later release compressed gas from the cylinder. Furthermore, the valve on the first end of the compressed gas cylinder is typically centered on the longitudinal axis of the cylinder. Second spacer 122 aligns second end 124 of the compressed gas cylinder in the spare surrounding space in the second end of the tube.

In one example, tube 102 is formed using High Density Polyethylene ("HDPE") resins for protection of compressed gas cylinder 114 through mechanical strength, chemical protection, corrosion resistance, and galvanic immunity. Preferably, the tube has a plurality of exterior corrugations 126, such as ridge 128 and groove 129. The corrugations contribute protection from the transfer through the tube and to the compressed gas cylinder of foreseeable impacts applied to the exterior of the tube. For example, one or more ridges could bend into their adjacent grooves in order to absorb a glancing blow while preserving the structural integrity of the tube, thereby protecting the compressed gas cylinder contained therein. For instance, the tube can be formed from corrugated PVC tubing. For purposes such as ease of handling by the user, container 100 can include amenities such as strap 107 that has its ends 109 attached to the tube, for instance, by connectors encircling the tube within grooves 129 at the attachment locations of the strap to the tube.

In one embodiment, first and second caps 108, 110 are formed from thick rubber in order to provide mechanical flexibility and hermetic sealing. In one example, the user installs either of the caps on tube 102 by substantially uniformly stretching the flange of the cap over the rim outside the corresponding one of ends 104, 106 and along a number of (e.g., two or three) ridges 128. For improved sealing, the user installs the second cap and preferably thereafter installs the first cap by deliberately stretching the first cap transversely outwardly from the tube during insertion over corrugations 126 in order to allow escape of excess air. Namely, when the first cap initially covers the first end of the tube after the second cap has already been installed, the first cap thereby captures an air pocket that is compressed as its flange is pulled longitudinally over the corrugations. Stretching the first cap transversely outwardly during installation relieves the pressure build-up as the air naturally escapes when given a passage between the cap and the corrugations. Therefore, the final assembly achieves a more stable steady-state condition because little or no pressure gradient exists across the cap since the release during installation allowed entropy to substantially equalize the pressure of the ambient air outside container 100 and in spare surrounding space 116 inside the container. Furthermore, the sealing of spare surround space around compressed gas cylinder 114 lends mechanical support to preserve the structure of the container and thereby protect the cylinder contained therein. That is, the sealed air in the spare surrounding space hydraulically resists compression. Therefore, this sealed air assists the tube and caps from caving inwardly due to exterior forces applied thereupon.

Optionally, first cap 108 can include pressure relief valve 130, such as a plug removably inserted into a hole defined in the first cap and connected by a neck to ring 131. In one example, steel plate 132 is fastened to the exterior of the first cap for retaining the parts of the pressure relief valve. For instance, the steel plate can define a hole sized to encircle or collar the neck and stop the plug as well as the ring. In one embodiment, the user can pull the ring to selectively release any excess pressure existing within container 100. For example, an indentation to tube 102 could reduce the volume of the container without decreasing the contents of the container for higher resulting pressure in spare surrounding space 116. Then, the user could tug the ring to relieve the increased pressure before taking the first cap off of first end 104 of the tube for removal of compressed gas cylinder 114 from the container. Alternatively, the pressure relief valve may be configured to automatically open or release when the pressure inside the container reaches a certain level. Furthermore, the steel plate would retain the parts of the pressure relief valve not only for convenience, but also for safety. Namely, without the steel plate, the plug-neck-ring could easily become projectiles which endanger the user upon dislodgement, due to tugging by the user or occurring spontaneously because of pressure build-up inside the container. In extreme circumstances of severe malady to the container or in the situation of preexisting defect in the compressed gas cylinder, breaking of the seals around or within the gas cylinder could create an undesirable, large pressure within the cylinder. Where the structural integrity of the container remains intact despite such inner tumult, whether or not the outward appearance of the container suggests catastrophe, the user can proceed to explore foreseeably dangerous conditions by operating the pressure relief valve. Nonetheless, the user would need to exercise caution and not open the pressure relief valve in the event noxious or toxic gases were being transported within the cylinder. Nevertheless, even in such dire instances as the rupture of a contained cylinder due to its own defect, the present invention advantageously seals the gases within the container.

For purposes such as shipping, transporting, or handling of container 100, the user can optionally fasten first clamp 133 around first cap 108 covering first end 104 of tube 102. The first clamp decreases any motivation of the first cap toward movement by increasing static friction of the first cap over, and transverse squeezing of the first cap about, the first end of the tube. One preferred embodiment always fastens second clamp 134 around the second cap covering second end 106 of the tube in order to increase mechanical support of second spacer 122 and compressed gas cylinder 114. For instance, the clamps 133, 134 can be formed from stainless steel. In addition, the first and/or second caps, including the clamps thereon, can be configured to separate from the tube when the pressure within the container reaches a desired level.

In one embodiment, the user fastens second cap 110 about second end 106 of tube 102, as described above, and engages second spacer 122 against the inner face of the second cap and telescopically with inner walls 112 of the tube. The second cap defines an opening for receipt of second end 124 of compressed gas cylinder 114. The second spacer contributes to maintenance of spare surrounding space 116 between the inner walls of the tube and the compressed gas cylinder in the second end of the tube. Preferably, the second spacer further contributes to axial alignment of the cylinder in the tube. For example, the second spacer can be a gasket.

Furthermore, first spacer 118 defines an opening for insertion around first end 120 of compressed gas cylinder 114. Moreover, the first spacer maintains spare surrounding space 116 between the inner walls of the tube and the compressed gas cylinder in the first end of the tube. For example, the first spacer can be a gasket made of a resilient material such as rubber. In particular, the first spacer and second spacer 122 cooperate to axially/longitudinally and transversely/radially align the cylinder in the tube. In one preferred embodiment, the first spacer maintains a hermetic seal between inner walls 112 of the tube and the compressed gas cylinder. In accordance with the present invention, subsequent to installation of the caps 108, 110 as described above, this hermetic seal assists in hydraulically securing the position of the cylinder.

In one aspect, compressed gas cylinder 114 has little or no relative movement longitudinally with respect to tube 102 because sealed air in the pockets of spare surrounding space 116 have no passages for flow through or around first spacer 118. The sealed air in these pockets resists compression and therefore dissuades the cylinder from leaving its inserted position. In another aspect, the pockets provided by the first spacer advantageously form a protective cushion for the cylinder against transversely-exterior impact, in accordance with the present invention. That is, the tube can flex into the space surrounding the cylinder without impacting the exterior of the cylinder. Further, the tube can desirably utilize the flexing space to absorb transverse strikes to its exterior and then harmlessly return to its original form, all without denting the cylinder. Similarly, the tube can aggregately flex in regions of its exterior (e.g., due to loading or unsupported shifting of container 100) without harming the cylinder.

In one preferred embodiment, handle 136 attached to first spacer 118 provides a means for removing the first spacer. For instance, the handle can include a gasket ring. As depicted in FIG. 2, the handle preferably is formed with a plurality of arms 138 having approximately uniformly spacing about the first spacer. This uniformity in spacing lends structural strength to the handle for increased longevity. Plus, the uniformity increases user control and comfort in handling the first spacer.

In one example, the user stores container 100 with second clamp 134 squeezing second cap 110 about second end 106 of tube 102. When not holding compressed gas cylinder 114, the container can nevertheless have first cap 108 covering first end 104 of the tube. First spacer 118 with holder 136 as well as second spacer 122 and other appropriate items such as dowels and rope can be stored inside the otherwise empty container. To insert the compressed gas cylinder, the user would preferably stand the container vertically on the second cap. The user slips off the first cap and removes any items stored within the container other than the second spacer, which would be positioned against the second cap with its perimeter along inner walls 112 and its opening opened toward the first end of the tube for impending receipt of second end 124 of the compressed gas cylinder. Then, the user would insert the cylinder through first end 104 of the tube for receipt of the cylinder second end into the opening of the second spacer while making sure the cylinder will be transversely centered between the inner walls. That is, the user seeks to prepare for symmetrical positioning of the cylinder in spare surrounding space 116. The user reaches through the first end of the tube and presses atop first end 120 of the cylinder for seating of the second end of the cylinder into the opening of the second spacer, while ensuring transversely symmetrical alignment of the cylinder within the container.

Next, the user positions first spacer 118 over valve 121 and onto first end 120 of compressed gas cylinder 114 with the opening of the first spacer opened toward second end 106 of tube 102 for mounting onto the first end of the cylinder. The first spacer is placed evenly about the first end of the cylinder for transverse, as well as longitudinal, symmetry in the forthcoming division into pockets of spare surrounding space 116. In one example, the user grasps handle 136 for insertion of the first cap onto the first end of the cylinder with arms 138 stretching thereover. One preferred embodiment employs one or more wooden dowels having a tapered end for pressing firmly and evenly on the first spacer around the cylinder and toward the tube second end (e.g., downward). As described above, the user utilizes the first spacer to create a hermetic seal between the first end of the cylinder and inner walls 112 of the first end of the tube, in accordance with the present. At this point, the cylinder is advantageously positioned transversely symmetrically within the inner walls.

Finally, the user covers first end 104 of tube 102 using first cap 108 and forming the stable, hermetic seal of container 100, as described above. In accordance with the present invention, the container now protects and positions compressed gas cylinder 114 for safe transport, handling, and storage. Furthermore, the container can assume numerous intended and unintended orientations and absorb all sorts of blows and harm while safely protecting and positioning the contained cylinder, in accordance with the present invention.

During the normal course of operation, the user at some point will wish to remove compressed gas cylinder 114 from container 100. In one example, the user stands the container vertically upon second cap 110. Where pressure relief valve 130 appears atop first cap 108, the user usually pulls or tugs outwardly (e.g., upwardly) on ring 131 to release any built-up pressure with the container, for safety to the user during ensuing removal of first cap 108, as described above. Typically, the user next peels, jostles, or otherwise works off the first cap. Then, the users employs any handle 136, rope, and wooden dowels, as desired, to remove first spacer 118 from first end 120 of compressed gas cylinder 114, by retrieving the first cap through the opening of first end 104 of tube 102. In the normal course of events, the user may need to exert force upon the first end of the compressed gas cylinder toward second end 106 of the tube (e.g., downward) in order to release the seal formed by the first spacer, for retrieval of the first spacer from the container without also lifting or otherwise moving the container therewith.

After removal of first spacer 118, the user proceeds in turn to remove compressed gas cylinder 114 from container 100. In unseating second end 124 of the cylinder from second spacer 122, the user may need to apply opposing (e.g., downward) force to the container, for example at first end 104 of tube 102.

In accordance with the present invention, the sealing of container 100 (which is completed using first spacer 108 and first cap 108) protects compressed gas cylinder 114 by holding or securing it in position. Furthermore, this sealing provides one or more pockets in spare surrounding space 116 for absorption of impact by tube 102. Moreover, the sealing works to relieve stress, strain, and fatigue of the working parts of the compressed gas cylinder by maintaining a pressurized envelope that serves to lower the gradient between it and the pressurized inside of the compressed gas cylinder.

Container 100 advantageously protects compressed gas cylinder 114 from impacts that often occur during transporting and/or handling. For instance, the container protects the gas cylinder against transverse-exterior impact or denting. Further, the container protects first end 120 (e.g., the valved-end) of the cylinder from accidental damage. Additionally, the container seals the cylinder against exterior-contaminant exposure. Moreover, the container desirably secures the cylinder against longitudinal movement or shifting. Also, the container protects the cylinder from wear and tear. For example, the container can protect the cylinder from chipping or scratching of its paint.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A compressed gas cylinder container comprising:

an elongate container sized and adapted to receive a compressed gas cylinder axially therein wherein a space exists between said gas cylinder and an inner wall of said container;

a first spacer adapted for mounting on a first end of said compressed gas cylinder wherein said first spacer mounted on said first end of said compressed gas cylinder contacts said inner wall of said container to create a space therebetween and said first spacer being tightly fit between said compressed gas cylinder and said inner wall of said container;

a second spacer located within a second end of said container and sized to receive a second end of said compressed gas cylinder therein to maintain said second end of said gas cylinder in alignment with said second end of said container and to maintain a space between said second end of said compressed gas cylinder and said inner wall of said container;

wherein said compressed gas cylinder having said first spacer mounted thereon, and inserted within said container with its second end received by said second spacer, is prevented from axial and radial movement relative to said container by said first and second spacer to protect said compressed gas cylinder;

means for mounting said first spacer on said first end of said compressed gas cylinder;

wherein said first spacer comprises a ring mountable around said first end of said compressed gas cylinder;

wherein said ring comprises a resilient material; and wherein said means for mounting comprises a handle protruding from said ring, said handle being exposed within an opening in said first end of said container for insertion and removal thereof.

2. The container of claim 1 wherein said first end of said container comprises a cap, said cap mountable over said opening to close said opening.

3. The container of claim 2 wherein said cap is secured over said opening using a clamp means.

4. The container of claim 2 wherein said second end of said container comprises a second opening, said container further comprises a second cap mountable over said second opening to close said second opening.

5. The container of claim 4 wherein said second cap is secured over said second opening using a second clamp means.

6. The container of claim 1 wherein said container is adapted to allow a maximum pressure therein.

7. The container of claim 6 further comprising a pressure relief valve therein.

8. The container of claim 2 wherein said first cap is adapted to allow the pressure within said container to be relieved when the pressure reaches a maximum value.

9. The container of claim 4 wherein said second cap is adapted to allow the pressure within said container to be relieved when the pressure reaches a maximum value.

10. The container of claim 4 wherein said container comprises a cylindrical tube.

11. The container of claim 10 wherein said tube is corrugated.

12. The container of claim 11 further comprising means for carrying said container.

* * * * *